US011776774B2

(12) United States Patent
Chai

(10) Patent No.: US 11,776,774 B2
(45) Date of Patent: Oct. 3, 2023

(54) KEYBOARD

(71) Applicant: LITE-ON TECHNOLOGY CORPORATION, Taipei (TW)

(72) Inventor: Yung-Nien Chai, Taipei (TW)

(73) Assignee: LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 17/672,468

(22) Filed: Feb. 15, 2022

(65) Prior Publication Data

US 2022/0293360 A1 Sep. 15, 2022

Related U.S. Application Data

(60) Provisional application No. 63/160,957, filed on Mar. 15, 2021.

(30) Foreign Application Priority Data

Dec. 7, 2021 (CN) ..... 202111483339.8

(51) Int. Cl.

| | |
|---|---|
| ***H01H 13/83*** | (2006.01) |
| ***H01H 13/7057*** | (2006.01) |
| ***H01H 13/704*** | (2006.01) |
| ***H01H 13/81*** | (2006.01) |
| *H01H 3/12* | (2006.01) |

(52) U.S. Cl.

CPC ..... *H01H 13/7057* (2013.01); *H01H 13/704* (2013.01); *H01H 13/81* (2013.01); *H01H 13/83* (2013.01); *H01H 3/125* (2013.01); *H01H 2219/06* (2013.01); *H01H 2219/0621* (2013.01)

(58) Field of Classification Search

CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20

See application file for complete search history.

(56) References Cited

U.S. PATENT DOCUMENTS

| | | | | |
|---|---|---|---|---|
| 6,971,807 | B2 * | 12/2005 | Tsai | H01H 3/125 361/679.13 |
| 7,850,378 | B1 * | 12/2010 | Ligtenberg | G06F 1/1662 400/490 |
| 8,569,640 | B2 * | 10/2013 | Yamada | H01H 13/86 200/302.1 |
| 2015/0021151 | A1 * | 1/2015 | Chen | H01H 13/83 200/5 A |

* cited by examiner

*Primary Examiner* — Ahmed M Saeed
(74) *Attorney, Agent, or Firm* — Innovation Counsel LLP

(57) ABSTRACT

A keyboard including a base plate, a plurality of keycaps, a plurality of supporting structures and a membrane switch element is provided. The base plate has a through hole. The keycaps are disposed on the base plate. The supporting structures are respectively disposed between the keycaps and the base plate. The membrane switch element is disposed on the base plate. The vertical projection of two adjacent keycaps of the keycaps relative to the base plate overlaps the through hole, and the membrane switch element has a shielding portion covering the through hole.

13 Claims, 6 Drawing Sheets

KEYBOARD

This application claims the benefits of U.S. provisional application Ser. No. 63/160,957, filed Mar. 15, 2021 and People's Republic of China application Serial No. 202111483339.8, filed Dec. 7, 2021, the subject matters of which are incorporated herein by reference.

BACKGROUND OF THE INVENTION

Field of the Invention

The invention relates in general to a keyboard, and more particularly to a frameless keyboard.

Description of the Related Art

Keyboard is a commonly used manual input device. For the user to more flexible use the keyboard, the press-key is normally provided with a supporting part and/or a balance bar to increase the structural strength of keycap. Moreover, through the supporting part and/or the balance bar, the keycap can move up and down with respect to the base plate. For the keyboard to have a sufficient space for receiving more press-keys, more and more keyboards are directed towards frameless design. However, since no frame is arranged between the press-keys to block the user's vision, the user can directly view the base plate and the through holes under the press-key through the gap between the press-keys, the user's feeling will be affected.

SUMMARY OF THE INVENTION

The invention is directed to a keyboard preventing the user from directly seeing the base plate and the through holes under the press-key from outside of the press-key.

According to one embodiment of the present invention, a keyboard is provided. The keyboard includes a base plate, a plurality of keycaps, a plurality of supporting structures and a membrane switch element. The base plate has a through hole. The keycaps are disposed on the base plate. The supporting structures are respectively disposed between the keycaps and the base plate. The membrane switch element is disposed on the base plate. The vertical projection of two adjacent keycaps of the keycaps relative to the base plate overlaps the through hole, and the membrane switch element has a shielding portion covering the through hole.

The above and other aspects of the invention will become better understood with regard to the following detailed description of the preferred but non-limiting embodiment(s). The following description is made with reference to the accompanying drawings.

DETAILED DESCRIPTION OF THE INVENTION

Detailed descriptions of the invention are disclosed below with a number of embodiments. However, the disclosed embodiments are for explanatory and exemplary purposes only, not for limiting the scope of protection of the invention.

It should be noted that these embodiments are for exemplary and explanatory purposes only, not for limiting the scope of protection of the invention. The invention can be implemented by using other features, elements, methods and parameters. The preferred embodiments are merely for illustrating the technical features of the invention, not for limiting the scope of protection. Anyone skilled in the art will be able to make suitable modifications or changes based on the specification disclosed below without breaching the spirit of the invention. Designations common to the accompanying drawings are used to indicate identical or similar elements.

Moreover, ordinal numbers, such as "the first", "the second", and "the third", are used in the specification and claims to modify the components of the claims. The ordinal numbers of claim components do not imply or represent that the said components have any previous ordinal numbers, nor represent the sequence between a particular component and another component or the sequence of process in a manufacturing method. The ordinal numbers are used to clearly distinguish the components having the same designations.

First Embodiment

Figure 1A:
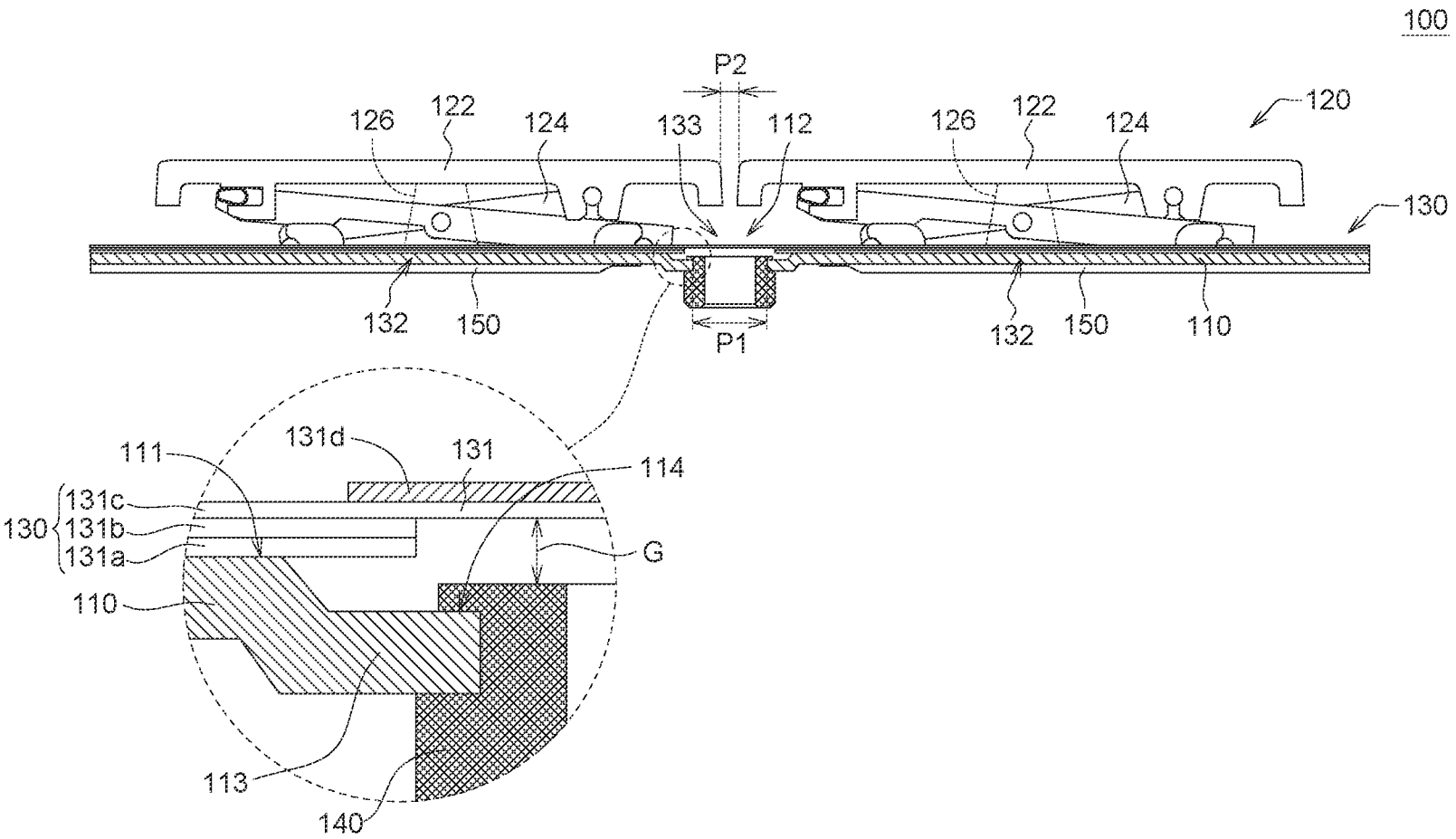
FIG. 1A is a side view and a partial enlargement of a keyboard according to an embodiment of the present invention.
Figure 2:
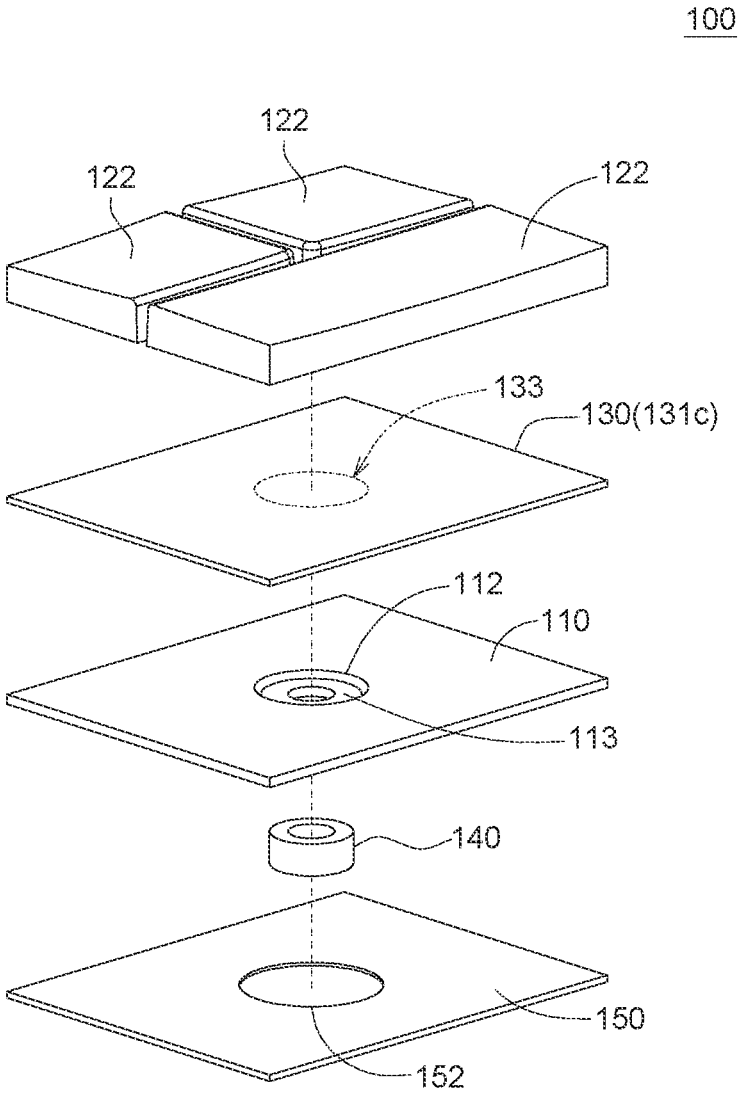
FIG. 2 is an explosion diagram of a part of the keyboard of FIG. 1A.

Refer to FIG. 1A and FIG. 2. FIG. 1A is a side view and a partial enlargement of a keyboard 100 according to an embodiment of the present invention. FIG. 2 is an explosion diagram of a part of the keyboard 100 of FIG. 1A. The keyboard 100 includes a base plate 110, a plurality of press-keys 120 (only two are illustrated in the diagram), a membrane switch element 130 and a fixing structure 140. The press-keys 120 can be flexibly disposed on the base plate 110. The base plate 110 has a through hole 112 located between two adjacent press-keys 120. The vertical projection of two adjacent keycaps 122 of the press-keys 120 relative to the base plate 110 overlaps the through hole 112. The membrane switch element 130 is disposed on the base plate 110. The press-keys 120 are correspondingly disposed above the membrane switch element 130. The fixing structure 140 is disposed on the base plate 110 and is correspondingly located under the area between two adjacent press-keys 120.

In FIG. 1A, the press-keys 120 can be a scissor type of press-key or other form of press-key. For example, the press-keys 120 can be any press-key of desktop keyboard or laptop computer. The press-key 120 can be a long key, such as space key, shift key, or tab key, or a square key, such as letter key, number key or function key.

The press-key 120 may include a keycap 122, a supporting structure 124 and an elastomer 126. The keycap 122 is disposed on supporting structure 124 and the elastomer 126. The supporting structure 124 and the elastomer 126 can be movably disposed between the keycap 122 and the base plate 110. The supporting structure 124 can be a scissor structure, a balance bar, or a lift shaft. The elastomer 126 (such as a rubber dome) is disposed in the supporting structure 124. Thus, when the keycap 122 is pressed by the user, the keycap 122 can move upward and downward with respect to the base plate 110 through the supporting structure 124 and the elastomer 126. Besides, when the keycap 122 is pressed, the membrane switch element 130 corresponding to the elastomer 126 is turned on to generate a pressing signal.

In the present embodiment, the membrane switch element 130 has a plurality of pressing portions 132 (only two are illustrated in the diagram) and a plurality of shielding portions 133 (only one is illustrated in the diagram). Each of the pressing portions 132 of the membrane switch element 130 is located under a corresponding press-key 120, and each shielding portion 133 is correspondingly located under the area between two adjacent press-keys 120. That is, in the direction of vertical projection, the pressing portion 132 of the membrane switch element 130 overlaps the keycap 122, the shielding portion 133 covers the through hole 112, and the width P1 of the through hole 112 is greater than the interval P2 between two adjacent keycaps 122 of the press-keys 120. Since the pressing portion 132 is blocked by the keycap 122, the user cannot see the inside of the press-key 120 from outside but can see the part of the base plate 110 within the interval area of two adjacent press-keys 120 and the fixing structure 140 disposed under the base plate 110 if no shielding portion 133.

In the present embodiment, to avoid the user directly seeing the fixing structure 140 from the gap between the keycaps 122, the membrane switch element 130 has at least one non-translucent film layer 131 disposed on the shielding portion 133. The film layer 131 is configured to the block the sight between the gap of the keycaps 122 and the fixing structure 140, so that the user cannot directly see the base plate 110 and the fixing structure 140 under the film layer 131 from outside.

In an embodiment, the non-translucent film layer 131 has a non-translucent coating 131*d*, such as a deep color coating or a silver color or white color coating, formed on the film layer 131 to avoid light penetration and the base plate 110 being exposed. It should be noted that the non-translucent coating 131*d* can be formed on the top surface of the film layer 131, that is, the side of the film layer 131 facing the keycap 122 or can be formed on the bottom surface of the film layer 131, that is, the side of the film layer 131 facing the base plate 110, or can be formed on both sides of the film layer 131.

Refer to FIG. 1A. The membrane switch element 130 includes a first circuit layer 131*a*, an insulation layer 131*b* and a second circuit layer 131*c*. The first circuit layer 131*a* is disposed on the base plate 110. The insulation layer 131*b* is disposed on the first circuit layer 131*a*. The second circuit layer 131*c* is disposed on the insulation layer 131*b*. To put it in greater details, the insulation layer 131*b* is disposed between the first circuit layer 131*a* and the second circuit layer 131*c*, the first circuit layer 131*a*, the insulation layer 131*b* and the second circuit layer 131*c* are stacked on top of each other. The first circuit layer 131*a* and the second circuit layer 131*c* are separated by a predetermined interval, and a pressing switch can be formed on the pressing portion 132 for the user to press and turn on. Also, the shielding portion 133 has a film layer 131, such as one or two of the first circuit layer 131*a*, the insulation layer 131*b* and the second circuit layer 131*c*. In the present embodiment, the film layer 131 is exemplified by the topmost second circuit layer 131*c*, but the present invention is not limited hereto.

Overall, the pressing portion 132 has three film layers, and the shielding portion 133 has one or two of the three film layers 131, so that the film thickness of the pressing portions 132 is greater than the film thickness of the shielding portion 133. Let the thickness of a film layer 131 be exemplified by 0.1 mm to 0.5 mm. The film thickness of the shielding portion 133 is about ⅓ or ⅔ of the film thickness of the pressing portion 132, therefore the shielding portion 133 provides more accommodation space than the pressing portion 132 by ⅓ to ⅔ of the accommodation space. That is, since the number of film layers of the shielding portion 133 is less than the number of film layers of the pressing portion 132, the shielding portion 133 forms a downward notch with respect to the pressing portion 132. As indicated in FIG. 1B, the downward notch can increase the accommodation space above the fixing structure 140, and the film layer 131 and the fixing structure 140 are separated by a predetermined interval G and will not contact each other to avoid the film layer 131 being scratched and the assembly quality of the keyboard 100 being affected.

Figure 1B:
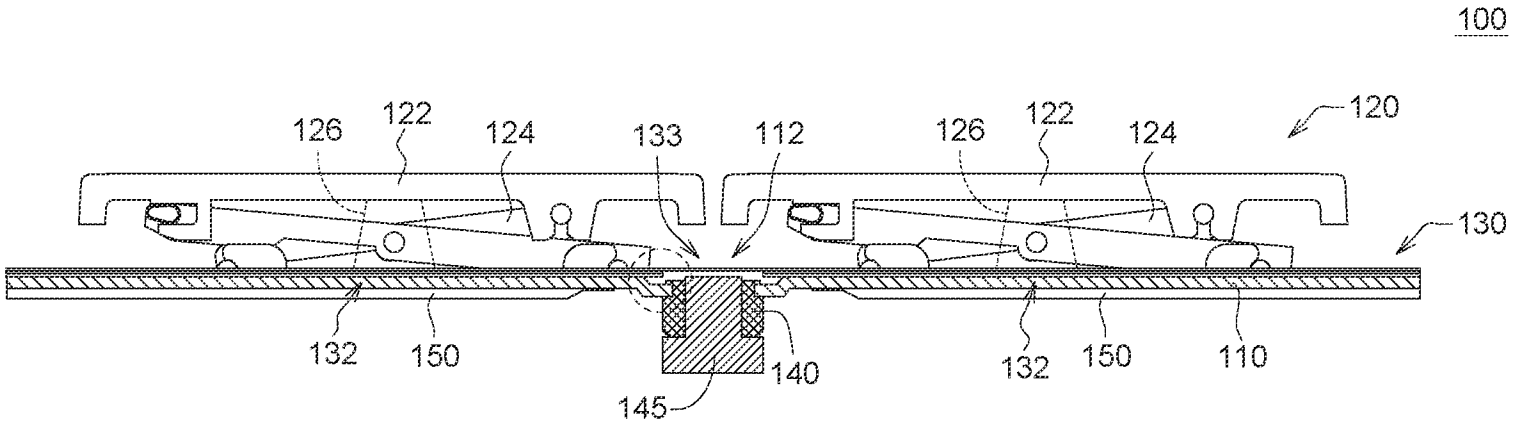
FIG. 1B is a side view of a keyboard with a fastener according to an embodiment of the present invention.

Refer to FIG. 1B. The fixing structure 140 can be a hollowed standoff whose one end is disposed in a through hole 112 of the base plate 110 and the other end extends to the underneath of the base plate 110. The base plate 110 can be made by an aluminum alloy sheet or an electroplated metal sheet. The fixing structure 140 can be made by a pressure riveting standoff with internal threads. The fixing structure 140 is embedded and riveted in the through hole 112 and is fixed on the thin base plate 110 whose thickness is less than 1 mm. The fixing structure 140 can enhance the strength and fixing force of the thin base plate 110 and can further provide an enough locking force. A fastener 145 passes through the fixing structure 140 to be locked on the fixing structure 140, so that the keyboard 100 can be assembled on the casing of a portable electronic device (not illustrated).

In an embodiment, the fastener 145 can be made by a screw. During the assembly of the keyboard 100, the top end of the fastener 145 may be slightly protruded from the fixing structure 140 and touch the membrane switch element 130. In the present embodiment, as the number of film layers of the shielding portion 133 is reduced (or the film thickness is reduced), the shielding portion 133 has an additional accommodation space in comparison to the pressing portion 132, and the top end of the fastener 145 will not touch the film layer 131 of the shielding portion 133. Thus, the membrane switch element 130 will not be scratched and the assembly quality of the keyboard 100 will not be affected.

Refer to FIG. 1B. In the present embodiment, the base plate 110 has a recessed portion 113 surrounding the through hole 112. The top surface 114 of the recessed portion 113 and the upper surface 111 of the base plate 110 are separated by a pre-determined distance. That is, the top surface 114 of the recessed portion 113 is recessed by stamping the sheet metal, so that the top surface 114 of the recessed portion 113 is lower than the upper surface 111 of the base plate 110 (not on the same horizontal plane). That is, the recessed portion 113 extends in a direction farther away from the keycap 122. Through the arrangement of the recessed portion 113, an additional accommodation space is formed between the upper surface 111 of the base plate 110 and the film layer 131 of the membrane switch element 130, such that the accommodation space above the fixing structure 140 is increased. The increased size of the accommodation space depends on the depth of the recessed portion 113, which is about ½ or even more than ½ of the thickness of the base plate 110, and the present invention does not impose specific restriction regarding the depth of recession.

It can be understood from the above disclosure that as the film thickness of the film layer 131 of the shielding portion 133 is reduced, a first accommodation space is additionally created above the fixing structure 140. Moreover, through the arrangement of the recessed portion 113 of the base plate 110, a second accommodation space is additionally created above the fixing structure 140. Through the arrangement of the present embodiment, the increased first and/or second accommodation space can receive the terminal end of the fixing structure 140 and/or the top end of the fastener 145 protruding from the fixing structure 140, hence avoiding the riveting burrs of the fixing structure 140 piercing or touching the film layer 131 and avoiding the top end of the fastener 145 passing through the fixing structure 140 and touching the film layer 131 of the membrane switch element 130.

On the other hand, since the film layer 131 of the shielding portion 133 blocks the sight between the gap of the keycap 122 and the fixing structure 140, the user cannot see the base plate 110 and the fixing structure 140 (inclusive of the fastener 145 in the fixing structure 140) under the film layer 131 from outside.

Refer to FIG. 2. The keyboard 100, which can be a desktop backlit keyboard or a laptop backlit keyboard, includes a backlit board 150. The backlit board 150 is disposed under the base plate 110 for guiding the light to the underneath of the press-key 120 to illuminate the translucent number or letter symbol on the keycap 122. Also, the backlit board 150 has an opening 152 corresponding to the fixing structure 140. The fixing structure 140 can pass through the opening 152 to be locked on the base plate 110. In another embodiment, the base plate 110 can have a through hole 112 without a recessed portion 113 surrounding the through hole 112. The fixing structure 140 can pass through the pressure riveting through hole 112 to be locked on the base plate 110, so that the top surface of the fixing structure 140 is aligned with or slightly protruded from the upper surface 111 of the base plate 110. The through hole 112 can be a round hole slot or polygonal slot, and the fixing structure 140 can be a cylinder or polygonal cylinder corresponding to the shape of the through hole 112. During the assembly of the keyboard 100, the fixing structure 140 riveted in the through hole 112 can resist the torque applied on the fixing structure 140 by the fastener 145, so that the keyboard 100 can be locked on the casing of the portable electronic device by the fastener 145.

Second Embodiment

Figure 3A:
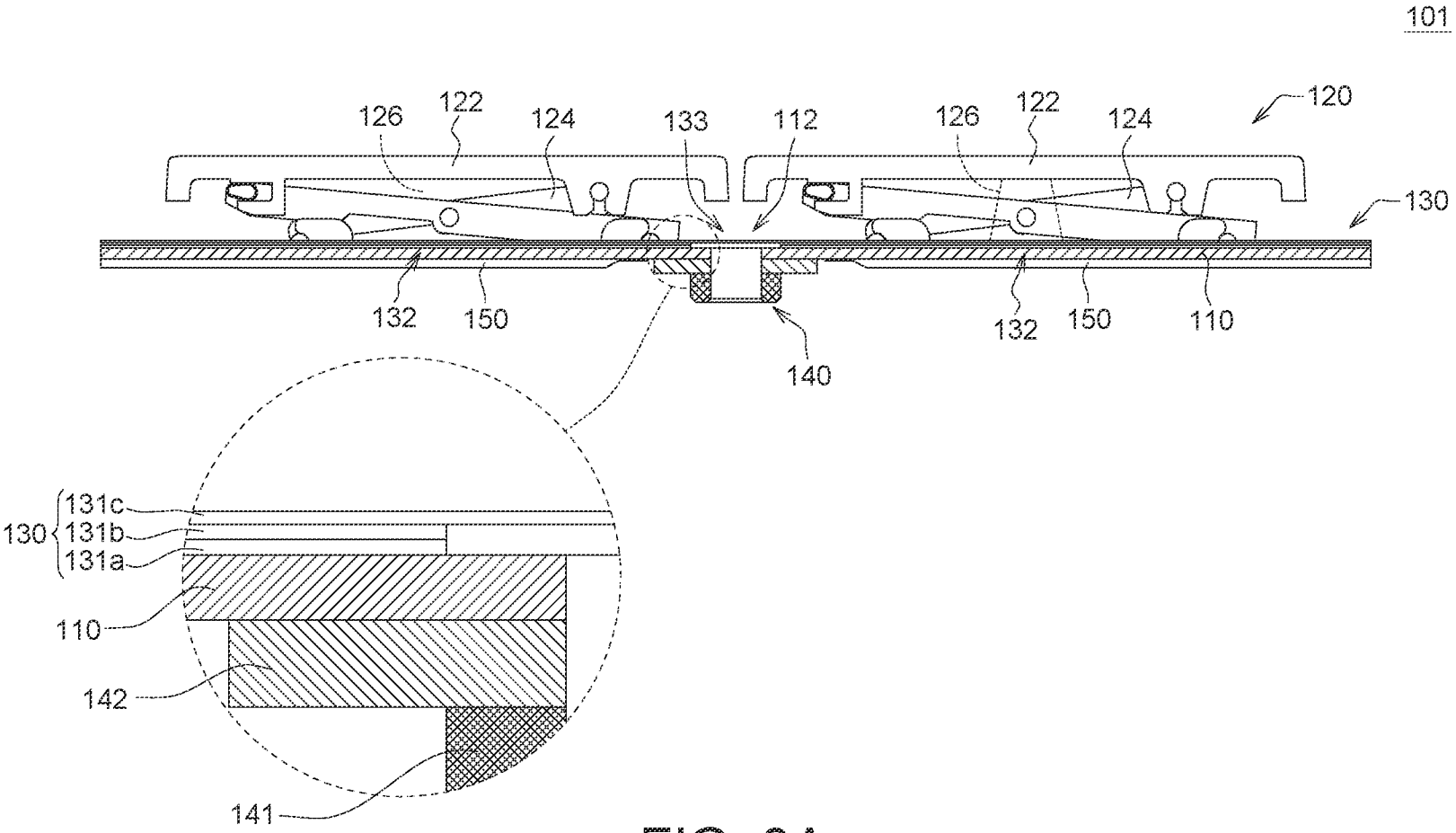
FIG. 3A is a side view and a partial enlargement of a keyboard according to the present invention another embodiment.
Figure 4:
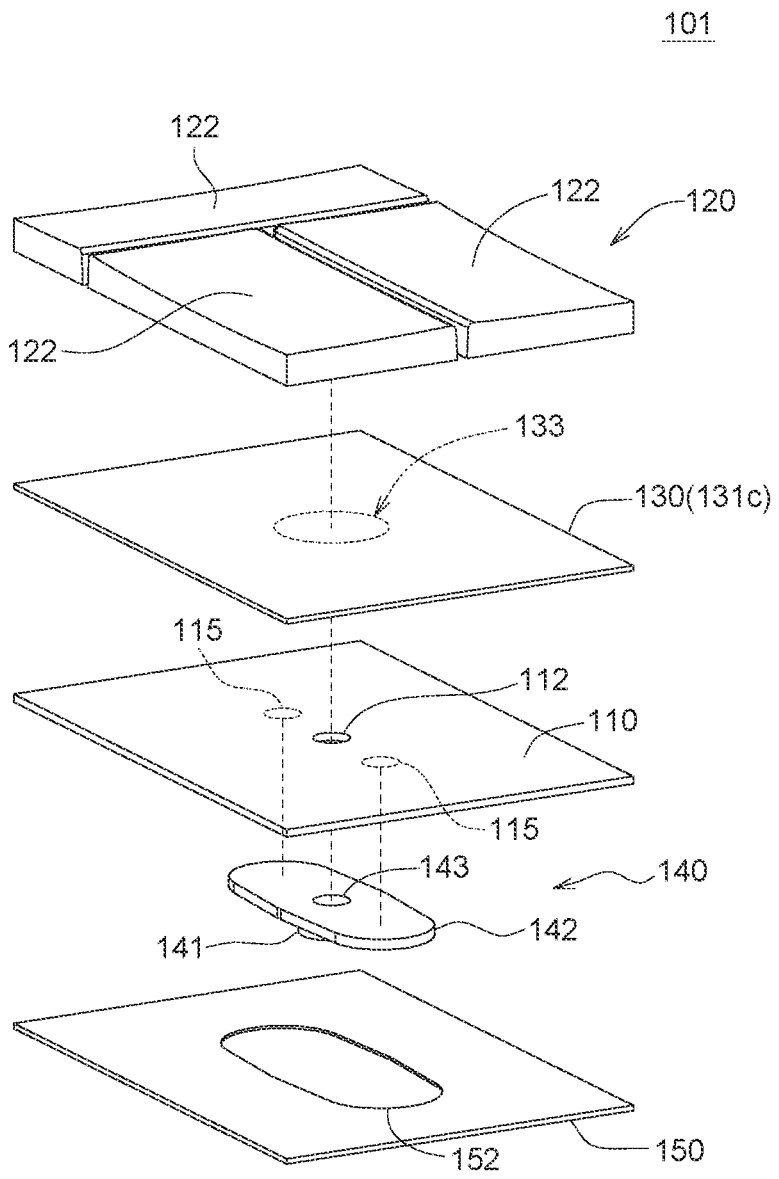
FIG. 4 is an explosion diagram of a part of the keyboard of FIG. 3A.

Refer to FIG. 3A and FIG. 4. FIG. 3A is a side view and a partial enlargement of a keyboard 101 according to another embodiment of the present invention. FIG. 4 is an explosion of a part of the keyboard 101 of FIG. 3A. The keyboard 101 includes a base plate 110, a plurality of press-keys 120 (only two are illustrated in the diagram), a membrane switch element 130, a fixing structure 140 and a backlit board 150. The keyboard 101 of the present embodiment and the keyboard 100 of the above embodiment are similar to each other but are different in that the fixing structure 140 of the present embodiment includes a standoff 141 and a bridging piece 142. The bridging piece 142 has a hole 143. One end of the standoff 141 is disposed in the hole 143 and the other end of the standoff 141 extends to the underneath of the bridging piece 142. The bridging piece 142 can be made by a plate (such as a metal sheet) disposed under the base plate 110. The standoff 141 can be a pressure riveting standoff 141 with internal threads. The standoff 141 is embedded and riveted in the hole 143 of the bridging piece 142 and is disposed on the thin bridging piece 142 whose thickness is less than 1 mm. Through the arrangement of the bridging piece 142, the standoff 141 is disposed under the base plate 110 and a predetermined space is additionally created between the standoff 141 and the base plate 110.

Figure 3B:
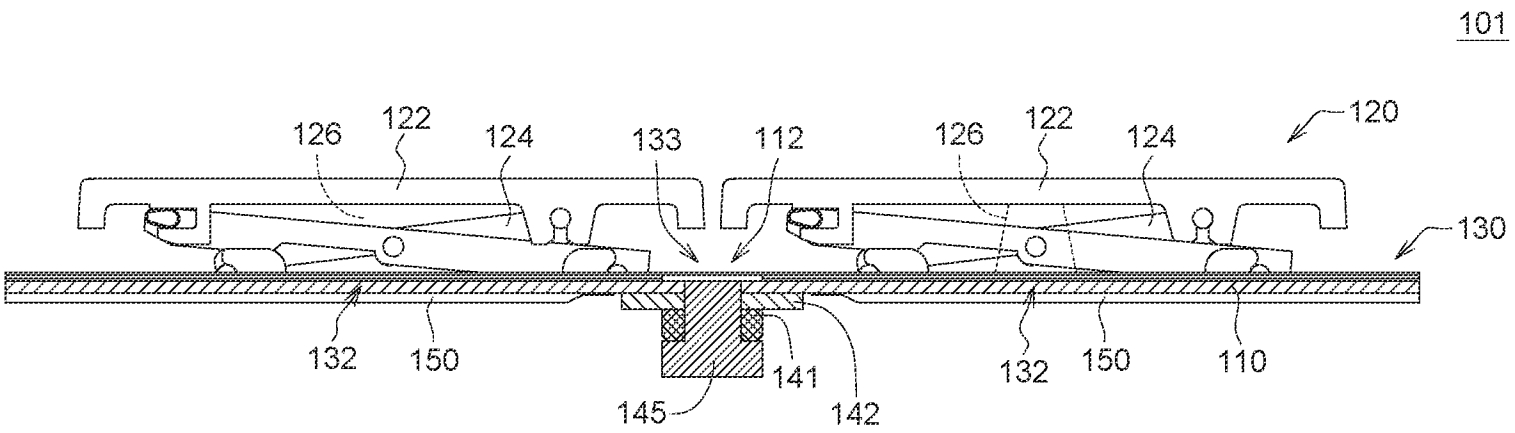
FIG. 3B is a side view of a keyboard with a fastener according to an embodiment of the present invention.

Refer to FIG. 3B. In an embodiment, a fastener 145 passes through the fixing structure 140 to be locked on the fixing structure 140, so that the keyboard 101 can be assembled on the casing of a portable electronic device (not illustrated). The fastener 145 can be made by a screw. During the assembly of the keyboard 101, the top end of the fastener 145 may be slightly protruded from the fixing structure 140. As the number of film layers of the shielding portion 133 is reduced (or the film thickness is reduced), the shielding portion 133 additionally has a first accommodation space in comparison to the pressing portion 132, and the top end of the fastener 145 will not touch the film layer 131 of the shielding portion 133. Thus, the membrane switch element 130 will not be scratched and the assembly quality of the keyboard 100 will not be affected.

Besides, the bridging piece 142 disposed under the base plate 110 additionally creates a second accommodation space above the standoff 141. Through the arrangement of the present embodiment, the increased first and/or second accommodation space can receive the terminal end of the fastener 145 passing through the fixing structure 140 to avoid the top end of the fastener 145 protruding from the fixing structure 140 and touching the film layer 131 of the membrane switch element 130.

On the other hand, since the film layer 131 of the shielding portion 133 blocks the sight between the gap of the keycap 122 and the fixing structure 140, the user cannot see the base plate 110 and the fixing structure 140 (inclusive of the fastener 145 of the fixing structure 140) under the film layer 131 from outside.

Refer to FIG. 4. The backlit board 150 has an opening 152 corresponding to the fixing structure 140. The fixing structure 140 can pass through the opening 152 to be locked on the base plate 110. In an embodiment, the bridging piece 142 of the fixing structure 140 can be fastened on the bottom surface of the base plate 110 by way of soldering, riveting or bolting on two contacts 115, so that the top surface of the fixing structure 140 is attached on the bottom surface of the base plate 110.

According to the keyboard of the present embodiment, the fixing structure is correspondingly located under the shielding portion of the membrane switch element. The shielding portion has a film layer, such as a non-translucent film layer for blocking the sight of the user seeing from the gap of keycaps to the fixing structure, so that the user cannot directly see the base plate and the fixing structure under the film layer from outside. Moreover, as the number of film layers of the shielding portion is reduced, the shielding portion has additional accommodation space with respect to pressing portion. The increased accommodation space leaves room for the assembly of the keyboard, hence avoiding the fastener scratching the film layer and affecting the assembly quality of the keyboard.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A keyboard, comprising:

a base plate having a through hole passing through an upper surface of the base plate and a bottom surface of the base plate;

a plurality of keycaps disposed on the base plate;

a plurality of supporting structures respectively disposed between the plurality of keycaps and the base plate; and a membrane switch element disposed on the base plate, wherein a vertical projection of two adjacent keycaps of the plurality of keycaps relative to the base plate overlaps the through hole, and the membrane switch element has a shielding portion covering the through hole, and a width of the through hole is greater than an interval between two adjacent keycaps of the plurality of keycaps.

2. The keyboard according to claim 1, wherein the shielding portion has a non-translucent coating.

3. The keyboard according to claim 1, wherein the membrane switch element has a plurality of pressing portions correspondingly located under the plurality of press-keys, each of the pressing portions has a first circuit layer, an insulation layer and a second circuit layer; the insulation layer is disposed between the first circuit layer and the second circuit layer; the pressing portions respectively have a pressing switch formed between the first circuit layer and the second circuit layer.

4. The keyboard according to claim 3, wherein a thickness of the pressing portion is greater than a thickness of the shielding portion.

5. The keyboard according to claim 3, wherein a number of film layers of the pressing portion is greater than a number of film layers of the shielding portion.

6. The keyboard according to claim 1, further comprising a fixing structure disposed on the base plate and correspondingly located under the shielding portion; the shielding portion and the fixing structure are separated by a predetermined interval.

7. The keyboard according to claim 6, wherein the fixing structure is a standoff whose one end is disposed in the through hole of the base plate and another end of the standoff extends toward underneath of the base plate.

8. The keyboard according to claim 6, wherein the fixing structure comprises a standoff and a bridging piece connecting the base plate and the standoff; the bridging piece has a hole; one end of the standoff is disposed in the hole of the bridging piece and another end of the standoff extends toward underneath of the bridging piece.

9. The keyboard according to claim 1, wherein the base plate comprises a recessed portion surrounding the through hole; a top surface of the recessed portion is lower than an upper surface of the base plate.

10. The keyboard according to claim 9, further comprising a fixing structure disposed on the base plate and corresponding fixed to the recessed portion under the shielding portion; the shielding portion and the fixing structure are separated by a predetermined interval.

11. The keyboard according to claim 10, wherein the fixing structure is a standoff whose one end is disposed in the through hole of the base plate and another end of the standoff extends toward underneath of the base plate.

12. A keyboard, comprising:

a base plate having a through hole passing through an upper surface of the base plate and a bottom surface of the base plate;

a plurality of keycaps disposed on the base plate;

a plurality of supporting structures respectively disposed between the plurality of keycaps and the base plate; and a membrane switch element disposed on the base plate, wherein the membrane switch element has a shielding portion corresponding to the through hole, the through hole is covered by the shielding portion, and a width of the through hole is greater than an interval between two adjacent keycaps of the plurality of keycaps, wherein the base plate comprises a recessed portion surrounding the through hole and a top surface of the recessed portion is lower than the upper surface of the base plate.

13. The keyboard according to claim 12, wherein the shielding portion has a non-translucent coating.

* * * * *